US005956816A

United States Patent [19]

McCrink

[11] Patent Number: 5,956,816

[45] Date of Patent: Sep. 28, 1999

[54] ELASTOMER COATING FOR BUTTONS, AND METHOD THEREFOR

[76] Inventor: David J. McCrink, 7 Ray Pl., Fairfield, N.J. 07054

[21] Appl. No.: 09/040,258

[22] Filed: Mar. 18, 1998

[51] Int. Cl.[6] ..... A44B 1/04

[52] U.S. Cl. ..... 24/113 MP; 24/114.9; 156/245; 156/267

[58] Field of Search ..... 24/90.1, 113 R, 24/113 MP, 114.9; 156/245, 212, 213, 267; 411/377, 903

[56] References Cited

U.S. PATENT DOCUMENTS

| | | | |
|---|---|---|---|
| 1,881,038 | 10/1932 | Whitehouse | 24/114.9 X |
| 2,214,030 | 9/1940 | Pereles . | |
| 2,397,856 | 4/1946 | Hagerty . | |
| 2,513,182 | 6/1950 | Kohl et al. . | |
| 2,535,794 | 12/1950 | Hempel . | |
| 3,787,935 | 1/1974 | Kapitan | 24/113 MP |
| 4,251,582 | 2/1981 | Bernier et al. . | |
| 4,387,488 | 6/1983 | Kanzaka . | |
| 4,580,320 | 4/1986 | Takata . | |
| 4,672,718 | 6/1987 | Schlueter et al. | 24/113 R X |
| 5,513,422 | 5/1996 | Wen-Lung . | |
| 5,728,246 | 3/1998 | Ewaschuk | 156/212 X |
| 5,753,063 | 5/1998 | Sakakibara et al. | 156/267 X |
| 5,756,189 | 5/1998 | Nagano et al. | 156/245 X |

FOREIGN PATENT DOCUMENTS

| | | |
|---|---|---|
| 1038451 | 9/1953 | France . |
| 1201101 | 9/1965 | Germany . |
| 2137867 | 10/1984 | United Kingdom . |

*Primary Examiner*—James R. Brittain
*Attorney, Agent, or Firm*—Richard C. Litman

[57] ABSTRACT

An elastomer coating for buttons, snaps, caps, and other metal fasteners, is provided by applying a bonding agent or primer coat to the fasteners, and then applying the elastomer material in solid sheet form to the tops or heads of the primer coated fasteners. The assembly is cured using heat and pressure, to bond the elastomer material permanently across the entire upper surface of the fasteners. The elastomer is preferably a synthetic silicone rubber material, which provides a soft to the touch feel. The permanently bonded coating also protects the underlying metal fastener material from corrosion, thus providing good durability and longevity for the fastener. The elastomer material may be clear, thus enabling any underlying pattern or design formed in the top of the fastener to be seen, but may be tinted or dyed if desired. Multiple layers of the elastomer material may be bonded to the top of the fastener, if desired, with each layer having a different translucent tint as desired. The present invention also includes a method of providing such an elastomer coating on a metal button or fastener, in accordance with the above described process.

20 Claims, 2 Drawing Sheets

ELASTOMER COATING FOR BUTTONS, AND METHOD THEREFOR

BACKGROUND OF THE INVENTION

1. Field of the Invention

The present invention relates generally to permanently applied coatings for articles, and more specifically to a chemically bonded elastomer or polymer coating for metal buttons, snaps, caps, and the like, and a method of permanently applying and bonding such a coating to such a metal article.

2. Description of the Related Art

Buttons, snaps, small plastic and metal caps, rivet heads, etc., have all been used for quite some time for securing various articles together, particularly in the clothing and apparel field. Buttons, snaps, etc. are commonly used as removable or openable closures and fasteners for clothing, while rivets are often used as permanent reinforcement means for highly stressed points in casual and work clothing. With most of the above types of fasteners, manufacturers have seen the desirability of providing some decorative appearance for the fasteners, in order to make them more attractive and thereby increase their sales to clothing manufacturers and to retail customers. In addition, such coatings increase the longevity of the metal fasteners to which they are applied, by precluding corrosion of the underlying metal base.

Various means of providing a more attractive appearance for such fasteners have been developed, from molding decorative relief patterns or designs in their surfaces, to providing different shapes and colors, to providing decorative coatings thereover. In many cases, it has been particularly desirable to cover such buttons with fabric material, particularly in the case of metal buttons, snaps, and the like. The fabric provides a more pleasing touch to the user, consistent with the feel of the fabric of the article to which they are attached, and reduces the sensation of heat or cold often felt when handling bare metal buttons, with their relatively low specific heat. However, such fabric coatings are almost universally mechanically secured to buttons, by crimping about the edge of the buttons or other means, rather than by chemically bonding the material to the button. Painting such buttons has also been used, but the relatively hard paint will often chip in a short period of time, under normal wear and tear.

Accordingly, a need will be seen for a means of coating metal buttons, snaps, and other fasteners with an elastomer or relatively soft polymer material, so the button will be soft and pleasant to the touch. The material should be chemically bonded to the button, in order to avoid problems of separation of the elastomer material from the fastener after a short period of time, and to avoid the complications of mechanical attachment means otherwise required.

A discussion of the related art of which the present inventor is aware, and its differences and distinctions from the present invention, is provided below.

U.S. Pat. No. 2,214,030 issued on Sep. 10, 1940 to Joseph L. Pereles, titled "Button," describes a button formed of two premolded or preformed components, with a planar sheet (picture, fabric material, etc.) sandwiched therebetween. The upper portion is a hard, transparent plastic secured to the opposite portion of the button, unlike the present invention in which a liquid coating is applied to the button, and then cured in place on the button. Moreover, Pereles fastens or seals his solid plastic button top to the button base only around the common periphery between the two components, rather than providing a continuous bonding at all points between the two components. Pereles cannot use such bonding, due to the intermediate layer between the two outer components, whereas the present invention is devoid of any such intermediate planar materials, with the upper elastomer or polymer being bonded directly to the metal beneath.

U.S. Pat. No. 2,397,856 issued on Apr. 2, 1946 to John J. Hagerty, titled "Decorative Button," describes a button having an opaque plastic base with a transparent or translucent crown cemented thereto. The crown includes a concave underside, so the only contact between crown and base is at the periphery, similar to the Pereles button discussed above. As in the Pereles button, the plastic top and base are cured, solid, non-elastic components which are then assembled together, rather than having an upper portion molded as a liquid to conform with the lower portion and being secured thereto about the entire interface therebetween, as in the present invention.

U.S. Pat. No. 2,513,182 issued on Jun. 27, 1950 to Herman Koehl et al., titled "Covered Buttons, Buckles, And The Like," describes multiple piece buttons and buckles wherein the pieces mechanically secure together to capture the periphery of a separate piece of fabric or other sheet material across the top of the device. No chemical bonding of a homogeneous plastic material to the metal substrate of the button is disclosed, as provided by the present invention.

U.S. Pat. No. 2,535,794 issued on Dec. 26, 1950 to Charles H. Hempel, titled "Method Of Preparing Ferrous Metal Objects For The Application Of Synthetic Resins," describes a method wherein the metal is cleaned using a caustic solution, etched in an acid bath, and then dipped in an alkaline solution, before applying the coating thereto. A critical part of the procedure is the formation of a thin film of ferric salt on the surface of the metal (column 1, line 43), which by definition cannot occur with non-ferrous metals. In the present invention, both ferrous and non-ferrous metals may be used, as no specific metallic chemical compound is required in the coating of the buttons. Rather, the present invention utilizes a chemical bonding or prime coating, which is followed after curing by a coating of an elastomer material which is also allowed to cure. Thus, the present invention utilizes a liquid chemical coating which bonds to the metal, with the elastomer material bonding to the prime coat, rather than bonding the finish material directly to the metal, as does Hempel.

U.S. Pat. No. 4,251,582 issued on Feb. 17, 1981 to Lonnie J. Bernier et al., titled "Dyeable And Dyed Polymer-Coated Articles," describes the powder coating of articles using various polyester, acrylic, or epoxy materials, and then heating the article and coating to cause the coating to adhere to the article. The coating is then dyed by suitable means. While the present invention provides for the use of colored coatings on buttons or the like, the method is entirely different, in that the coating material is dyed or colored first, before being applied to the substrate material. Moreover, the present invention does not use a powder coating method to apply the coating to the substrate, as disclosed by Bernier et al.

U.S. Pat. No. 4,387,488 issued on Jun. 14, 1983 to Yoshihiro Kanzaka, titled "Fabric-Covered Button," describes a mechanical system wherein the fabric material is sandwiched about its periphery between opposing solid members. The result is more closely related to the buttons of the Koehl et al. '182 U.S. Patent, than to the present invention.

U.S. Pat. No. 4,580,320 issued on Apr. 8, 1986 to Akihiko Takata, titled "Button Having Plastic Resin Head," describes the mechanical fastening of the plastic head to the base of the button. The base is captured within the overlapping edges of the plastic head, by heating the base to soften the plastic and then inserting the base into a preformed cavity in the head. No chemical bonding of a coating to a metal substrate is disclosed by Takata, as provided in the present invention.

U.S. Pat. No. 5,513,422 issued on May 7, 1996 to Ho Wen-Lung, titled "Crown Button Of A Cap," describes a retaining means for a cap crown button, which includes a metal cover with a fabric overlay peripherally captured between the cover and the underlying portion of the button. The result is more closely related to the buttons of the Koehl et al. '182 and Kanzaka '488 U.S. Patents, than to the present invention.

French Patent Publication No. -1,038,451 published on Sep. 29, 1953 illustrates different embodiments of a button having a trim overlay thereon. In each of the embodiments, the trim sheet is mechanically secured about the periphery of the button, with the result being more similar to the buttons of the Koehl et al. and Kanzaka U.S. Patents discussed above, than to the present invention.

German Patent Publication No. 1,201,101 published on Sep. 16, 1965 illustrates a button having upper and lower layers of fabric mechanically attached thereto. As noted above, this mechanical fastening of fabric to buttons, is more closely related to other patents described herein, than to the present invention.

Finally, British Patent Publication No. 2,137,867 published on Oct. 17, 1984 to Gregory C. Scott, titled "Buttons," describes a button having a fabric cover captured about its periphery between two rigid components, in the manner of the Koehl et al. and Kanzaka U.S. Patents described further above.

None of the above inventions and patents, either singly or in combination, is seen to describe the instant invention as claimed.

SUMMARY OF THE INVENTION

The present invention comprises an elastomer coating for metal buttons, snaps, caps, rivet heads, and the like, and a method for permanently applying and bonding such a coating to such articles. Briefly, the method comprises coating the metal article(s) with a priming or bonding agent, which bonds and adheres securely and permanently to the underlying clean metal surface. The elastomer material is mixed with a catalyst, and allowed to cure. Solid sheets or strips of the elastomer material are then placed over the tops or heads of the buttons or other articles, and heat and pressure are applied to the assembly. This causes the catalyst to cross-link the elastomer molecules, and simultaneously causes the cured elastomer to bond to the metal, by means of the bonding agent previously applied to the metal caps or the like.

The present invention is preferably applied to any metal button or fastener material, whether formed of ferrous or non-ferrous metal. The preferred elastomer is a clear or tinted synthetic silicone rubber material, which allows the underlying surface of the button or fastener to be seen through the elastomer when the elastomer is bonded completely to the entire underlying surface. The preferred bonding agent or prime coat is a dilute solution of moisture reactive materials in VM&P naphtha. The preferred catalyst for the elastomer is an organic peroxide, with the specific compound depending upon whether a tint or dye is added to the material. The result is a durable, long lasting, soft to the touch coating for fasteners formed of any metal material.

Accordingly, it is a principal object of the invention to provide an improved elastomer coating for buttons, snaps, rivet heads, and other metal fasteners.

It is another object of the invention to provide an improved elastomer coating for such fasteners, comprising a synthetic silicone rubber material which provides a soft to the touch feel for such articles when the elastomer has been bonded thereto.

It is a further object of the invention to provide an improved elastomer coating for metallic fasteners which is permanently and securely bonded to the entire upper surface of the fastener by means of a chemical bonding or priming agent applied to the fastener, precluding any requirement for mechanical means for securing the coating material to the fastener.

An additional object of the invention is to provide an improved elastomer coating for metallic fasteners which may be tinted, dyed, or colored as desired.

Still another object of the invention is to provide an improved method for achieving the above elastomer coatings for fasteners.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises an elastomer coating for the heads or caps of metal fasteners (buttons, snaps, rivets, etc.), as well as such metal fasteners having such elastomer coatings thereon. A method of coating the heads or caps of such metal fasteners with one or more sheets of elastomer material, is also included as a part of the present invention. The present elastomer coated fasteners may be applied to clothing and other goods formed of fabrics or other flexible sheet material (handbags, backpacks, etc.), to serve as fasteners and/or for decorative purposes. The soft touch provided by the elastomer material covering the heads or caps of the fasteners, provides a pleasant tactile feel for a user of the fasteners, rather than the harsh sensation of bare metal.

Figure 1:
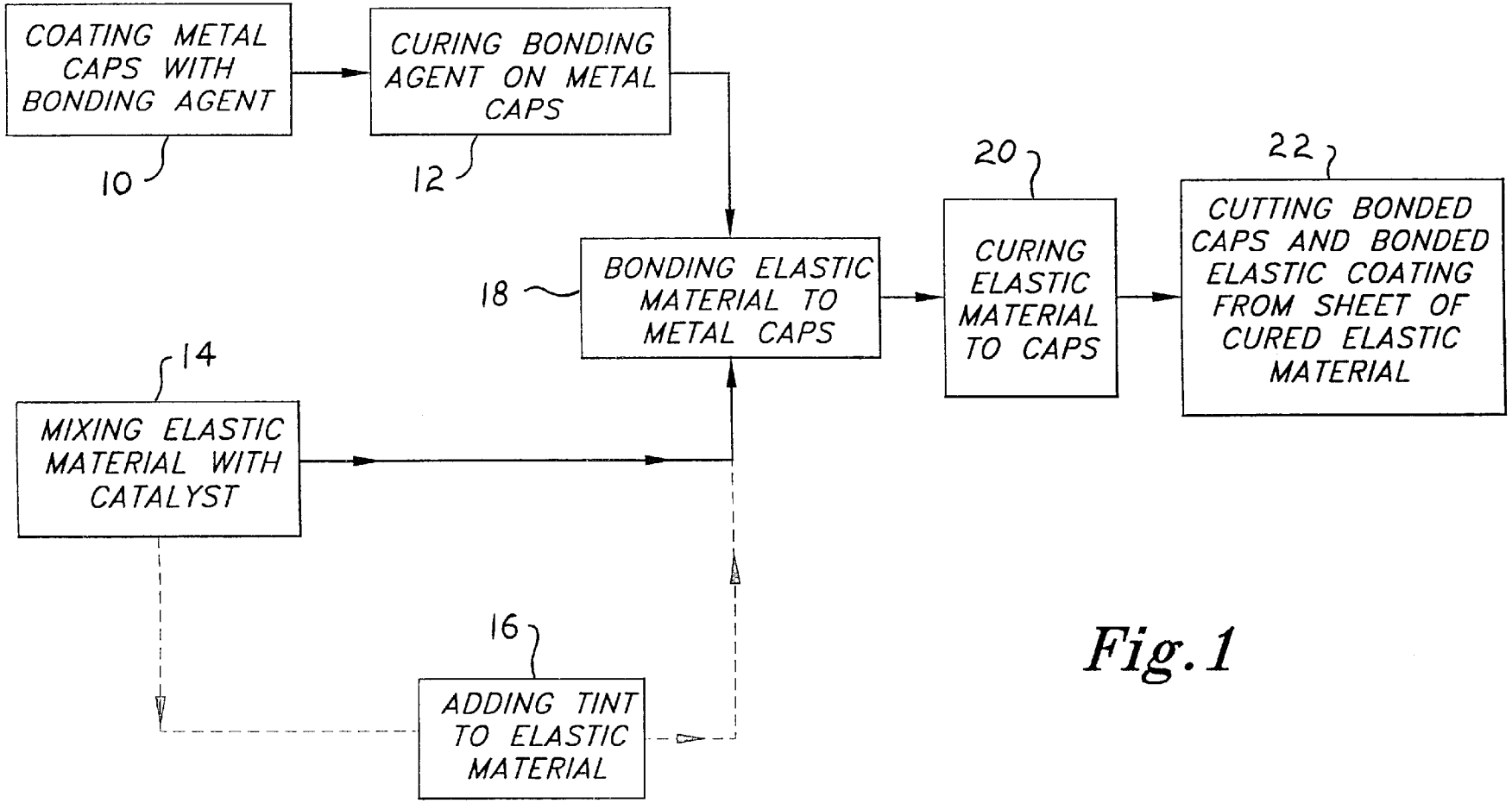
FIG. 1 is a flow chart disclosing the various steps in the method of achieving the present elastomer coating for metallic fasteners.

FIG. 1 provides a flow chart or diagram illustrating the basic steps involved in forming the elastomer coated fasteners of the present invention. Initially, appropriate fasteners are procured for the process. Such fasteners may be in virtually any form, including conventional buttons, snap type fasteners, rivets, or even other types of fasteners such as buckles, clasps, etc. The only critical requirement of any of the fasteners used with the present invention, is that the portion of the fastener to be coated with the elastomer material, be formed of metal. Thus, plastic buttons, clasps, etc. could be used in the present invention, so long as the cap or head portion of the device is formed of, or coated with, metal. The specific type of metal is not critical to the function of the present invention; any type of metal from which fasteners are conventionally formed, either ferrous or non-ferrous, is equally suitable.

The metal head portions of the fasteners are cleaned, and the clean metal caps or heads are coated with a suitable bonding agent, as shown generally in the first step 10 of FIG. 1. (The entire fastener may be dipped in the bonding agent if so desired, for ease of application of the agent. However, only the metal head portion of the fastener need be coated with the bonding or primer agent.) The preferred bonding agent material for bonding the preferred elastomer material of the present invention to the fasteners, comprises a dilute solution of moisture-reactive materials in VM&P naphtha. The Dow-Corning Company produces such a material, under the name of Dow-Corning Prime Coat #2260.

The fasteners (or at least the fastener heads) remain in the prime coat material for at least fifteen minutes, and are then drained to remove excess prime coat or bonding agent material. The coated fasteners (or fasteners with their coated heads or caps) are immediately placed in an atmosphere of steam for at least thirty minutes, to provide a high humidity for hydrolysis or curing of the bonding agent material on the fastener heads, generally as indicated in the second step 12 of FIG. 1. At this point, the coated fasteners (or fastener heads) are ready to accept the chemical bonding of elastomer material thereto.

The elastomer material is preferably a synthetic silicone rubber material, although other materials may be used, depending upon the specific bonding agents and catalysts used with the elastomers. The elastomer material used in the preferred embodiment described herein, is a no post-cure blend of Dow-Corning TR-70 and Q-44768 elastomer materials, with their specific ratios being adjustable depending upon the specific application. The preferred catalyst used in forming the elastomer material of the present invention is an organic peroxide, which may be provided in different forms depending upon whether the elastomer material is to be clear or translucently tinted. For clear elastomers, the catalyst material is an organic 100% peroxide in liquid form, having the chemical composition 2,5 dimethyl-2,5 di/t-butylperoxy/hexane. A slightly modified form of this catalyst in a 50% peroxide powder form, is preferred when the elastomer material is to be colored or tinted.

Either of the above catalysts may be supplied by Dow-Corning Company, as DBPH-100 for clear elastomers, or as DBPH-50 for colored or tinted elastomers. The appropriate catalyst is added to the elastomer material as indicated in the third step 14 of FIG. 1, with the coloring agent, tint, or dye being mixed with the catalyst and/or uncured elastomer material as desired, in accordance with the optional fourth step 16 of FIG. 1. While alternative catalytic agents may be used (e.g., platinum and tin compounds), the above described peroxide catalytic compounds are preferred with the silicone rubber elastomer material of the preferred embodiment of the present invention, as other catalytic agents do not provide the bonding strength of the peroxide catalysts described above.

Once the bonding agent has been applied and cured to the metal caps or heads of the buttons or other fasteners, as indicated in the first and second steps 10 and 12 of FIG. 1, and the elastomer material has been catalyzed (and tinted, as desired) as indicated in the third and optional fourth steps 14 and 16 of FIG. 1, the elastomer material may be applied to the metal caps or heads of the fasteners or buttons, as shown generally in the fifth step 18 of FIG. 1. When the catalyzing process has been completed in the elastomer material, the material will be in the form of a resilient solid. Preferably, this material is formed in sheets having thicknesses on the order of from one one hundredth of an inch, to one tenth of an inch (0.01" to 0.1"). It will be seen that multiple layers or thicknesses may be applied to the fastener caps, as desired.

The fasteners are placed in a suitable container or holder, with their heads or caps all facing upwardly. (This may be done by hand, with care being taken not to contaminate the primer coated fastener heads with the hands, or by automated means, e.g., a shaker table which causes the fasteners to turn head down, with the tray of fasteners then being inverted to position the heads or caps upright.) The catalyzed elastomer material is then placed in sheets directly atop the bonding agent coated caps or heads of the fasteners.

Figure 3:
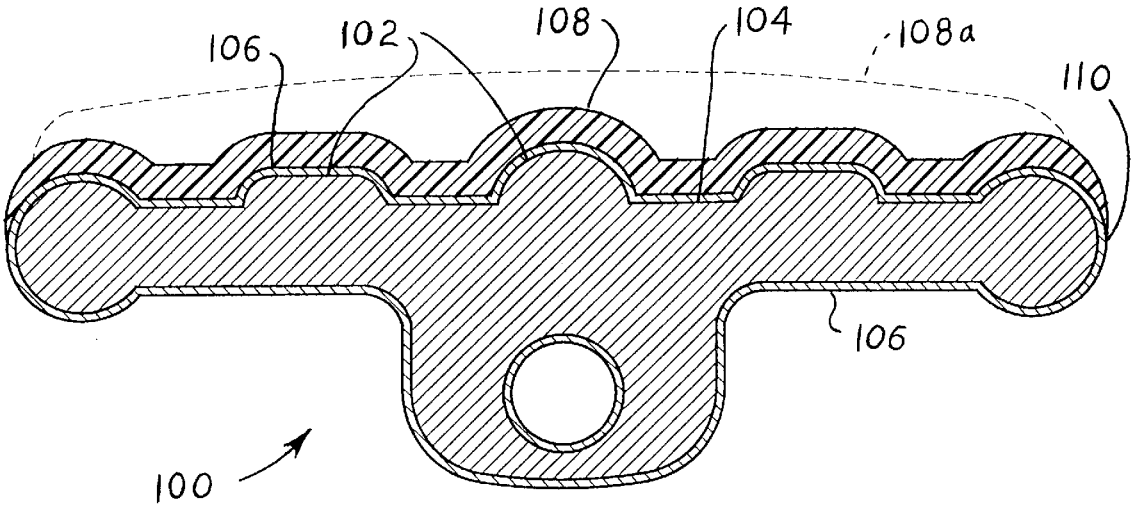
FIG. 3 is an elevation view in section of the button of FIG. 2, showing the distribution of the bonding agent and elastomer thereover, and further showing an alternative thicker elastomer coating thereon.

The actual bonding and curing of the elastomer material to the fastener heads is accomplished by means of a heat and pressure process, where a heated plate or the like is placed atop the elastomer sheet, and pressure is applied to the plate to press the elastomer material downwardly onto the heads or caps of the fasteners. The curing temperature is approximately 340 degrees Fahrenheit, with the plate being left in place for about two minutes to achieve a complete cure and bonding of the elastomer material to the fastener heads or caps, generally as indicated in the sixth step 20 of FIG. 1. The plate may include complementary relief patterns matching any relief patterns of the heads or caps of the fasteners, thereby creating a contour of the bonded elastomer material which closely follows the upper contour of the fastener, as shown in FIG. 3 and discussed further below. Alternatively, the elastomer may have a smooth and regular contour, as indicated by the alternative broken line configuration shown in FIG. 3.

The above described process is not limited to the bonding of only a single sheet or thickness of elastomer material to the fasteners. Rather, the heat and pressure process used for bonding, may be used to bond multiple layers or sheets of elastomer material together and to the tops of the fasteners. This produces particularly striking effects, when each sheet or layer of the elastomer material has been translucently tinted with a different color or tint, as described further above.

Once the curing process has been completed, the plate is removed from the fasteners and excess elastomer material is cut from the peripheries of the fastener heads or tops, as indicated generally by the final seventh step 22 of FIG. 1. Punches, dies, or other automated means may be used to perform this operation. It will be seen that due to the bonding of the elastomer material over the entire upper surface of the fasteners, no mechanical means is required to secure the elastomer to the fasteners. While some excess of elastomer material could be left to extend beyond the peripheries of the fasteners, and around and beneath the lower edges of the tops or caps of the fasteners, this is not at all required in the present invention, as it is in other covered buttons and fasteners, where mechanical attachment means is used to secure the covering to the head of the button. The present means of chemically bonding the elastomer coating to the top of the fasteners, is completely devoid of any mechanical attachment means between the coating and the underlying fastener head or cap.

Figure 2:
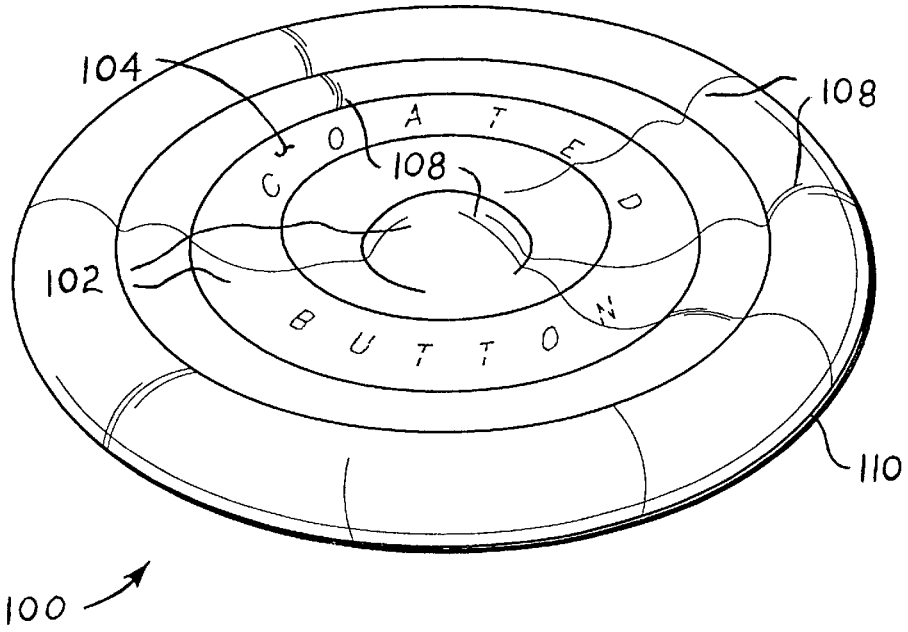
FIG. 2 is a perspective view of a button which has been coated with the elastomer coating of the present invention.

FIGS. 2 and 3 respectively provide a perspective and an elevation view in section, of a button fastener 100 which has been coated with an elastomer material in accordance with the present invention. The button 100 is formed of metal, or at least includes a metal upper surface, cap, or head. The button 100 may include some form of relief pattern 102 over the upper surface or portion 104 thereof, as shown in FIGS. 2 and 3, or may have a plain and unornamented upper surface. While the button 100 of FIG. 2 is round, it will be appreciated that as the present elastomer coating for buttons is chemically bonded to the upper surface 104 of the button 100, that such buttons may be formed in any practicable shape or configuration, e.g., square, round, snaps, caps, rivets, etc., without affecting the operability of the present invention.

The fastener or button 100 has a first layer 106 comprising the bonding agent or prime coat, described further above. This bonding agent coating 106 may be provided over the entire surface of the button 100, as shown in the sectional elevation view of FIG. 3. However, only the upper surface or head portion 104 of the button 100 need be coated with this bonding agent first layer 106, as it is solely for the purpose of chemically bonding the second or outermost layer 108 of elastomer material to the button 100, which elastomer material 108 is only applied to the upper surface or head 104 of the button 100. As the elastomer layer 108 is normally trimmed at the periphery 110 of the button 100 and does not extend beyond the periphery 110, the bonding agent coating 106 need not extend beyond the lateral periphery 110 of the button 100.

As noted further above, the preferred first coating or bonding agent 106 is a dilute solution of moisture reactive materials in naphtha, with the specific chemical formulations being disclosed further above in the description of the method of carrying out the present invention. (It will be understood that the thickness of this coating is considerably exaggerated in FIG. 3, for the sake of clarity in the drawing figure.) The preferred elastomer coating comprising the outermost or uppermost second layer 108, is a synthetic silicone rubber material which is catalyzed to form a resilient sheet material and then bonded and cured to the upper surface 104 of the button fastener 100, by means of the underlying bonding agent layer 102 between the metal upper surface 104 of the button 100 and the overlying elastomer coating 108.

The uppermost elastomer coating layer 108 shown in FIG. 2 is clear or translucent, in order to show any design which may be formed on or as a part of the underlying upper surface 104 of the button fastener 100, e.g., the legend "coated button" 112 shown in FIG. 2 and representing a trade or brand name or other logo or design as desired. The formation of such translucent tinted elastomer materials 108 was described further above, in the portion of the present disclosure relating to the method of accomplishing the present invention. It will further be seen that multiple layers of elastomer material, e.g., a second layer 108 and a third layer 108*a* thereabove, as shown in FIG. 3, may be provided atop the button 100, using the same curing procedure as for a single layer 108 of elastomer material.

When such multiple layers 108, 108*a*, etc. are provided, each may be translucently tinted to have a different shade or color, thereby providing further beauty and interest to such elastomer coated fasteners 100. The continuously chemically bonded interface between the clear or translucent elastomer material 108 and the underlying upper surface 104 of the fastener 100, provides an optically clear coating enabling the underlying button surface 104 to be seen clearly, whereas mechanically secured button coatings where no chemical bonding is used, cause a cloudy or semi-opaque appearance between the coating and the underlying button surface. A review of FIG. 3 will also show that the elastomer coatings 108 or 108*a* may be of any practicable thickness, such as the relatively thin coating 108 which conforms and follows the contours 102 of the upper surface 104 of the button 100, or the relatively thick coating or layer 108*a*, which may be bonded to the underlying upper surface 104 of the button 100 without any intervening thinner elastomer coating, if so desired.

In summary, the present invention enables metal (or metal topped) buttons, buckles, clasps, rivets, etc. to be coated with a soft-to-the-touch elastomer material, which still enable any underlying logo or design on the button surface to be viewed clearly. The elastomer material provides a significant improvement in tactile feel over the relatively harsh metal surfaces of such uncoated buttons, particularly in extreme weather conditions (hot or cold).

The chemical bonding of the elastomer material to the metal surface of the button or fastener, obviates any need for mechanical securing of the coating to the fastener, as practiced in the prior art, and also provides an optically clear view of the surface of the underlying button. While the elastomer material used in the present invention may be provided in an optically clear state, coloring or tinting agents may be added to the material to provide translucently colored coatings, as desired, with one or more sheets of such material in clear or one or more translucent shades being applied to the underlying button as desired, in accordance with the present invention.

As the coating material is bonded to the underlying fastener surface, it need not extend beyond the periphery of the fastener, as in the case of mechanically secured coatings and coverings for buttons and fasteners. However, it will be seen that the coating material may be applied over the entire fastener surface, or at least surrounding the periphery of the fastener, if so desired, depending upon the coverage of the underlying bonding agent coat applied to the fastener. In any case, the elastomer coating of the present invention will find great favor by purchasers of apparel and other articles which utilize metal or metal coated buttons in their construction.

It is to be understood that the present invention is not limited to the embodiments described above, but encompasses any and all embodiments within the scope of the following claims.

I claim:

1. A coating for a fastener having at least a metal head portion with a lateral periphery, comprising:

a first layer including a bonding agent applied over at least the entire metal head portion of the fastener, and cured thereto; and a second layer applied over the entire metal head portion of the fastener and said first layer, and chemically bonded to said first layer and thereby to the entire metal head portion of the fastener, said second layer extending up to the lateral periphery of the head of the fastener and being devoid of mechanical attachment to the head of the fastener;

wherein said second layer having a plurality of solid elastomer sheets successively applied to the head of the fastener, each sheet of said plurality of sheets successively modifying a previous sheet.

2. The fastener coating according to claim 1, wherein each sheet of said plurality of elastomer sheets being formed of synthetic silicone rubber material, and said bonding agent comprises a dilute solution of moisture reactive materials in naphtha.

3. The fastener coating according to claim 1, wherein one sheet of said plurality of elastomer sheets being clear.

4. The fastener coating according to claim 1, wherein one sheet of said elastomer sheets being translucently tinted.

5. The fastener coating according to claim 4, said plurality of elastomer sheets each tinted differently from one another.

6. The fastener coating according to claim 1, wherein said second layer being a thin coating, following the contours of the metal head portion of the fastener.

7. The fastener coating according to claim 1, wherein said second layer being a substantially thick coating across the entire metal head of the fastener.

8. An elastomer coated fastener, comprising:

a fastener having at least a metal head portion and a lateral periphery;

a first layer including a bonding agent applied at least over the entirety of said metal head portion of said fastener, and cured thereto; and a second layer applied over the entirety of said metal head portion of said fastener and said first layer, and chemically bonded to said first layer and thereby to said entirety of said metal head portion of said fastener, said second layer extending up to said lateral periphery of said head of said fastener and being devoid of mechanical attachment to said head of said fastener;

wherein said second layer including a plurality of solid elastomer sheets successively applied to the head of the fastener, each sheet of said plurality of sheets successively modifying a previous sheet.

9. The elastomer coated fastener according to claim 8, wherein each sheet of said plurality of sheets being formed of synthetic silicone rubber material, and said bonding agent comprises a dilute solution of moisture reactive materials in naphtha.

10. The elastomer coated fastener according to claim 8, wherein one sheet of said plurality of sheets being clear.

11. The elastomer coated fastener according to claim 8, wherein one sheet of said plurality of elastomer sheets being translucently tinted.

12. The elastomer coated fastener according to claim 11, said plurality of elastomer sheets each tinted differently from one another.

13. The elastomer coated fastener according to claim 8, wherein said second layer being a thin coating, following the contours of said metal head portion of said fastener.

14. The elastomer coated fastener according to claim 8, wherein said second layer being a substantially thick coating across the entirety of said metal head of said fastener.

15. The elastomer coated fastener according to claim 8, wherein said fastener is selected from the group consisting of buttons, snaps, caps, and rivets.

16. A method of coating the head of a metal fastener with an elastomer material, comprising the following steps:

(a) coating the head of the metal fastener with a bonding agent;

(b) curing the bonding agent to the head of the metal fastener;

(c) catalyzing the elastomer material for application to the head of the metal fastener;

(d) applying at least one solid sheet of the catalyzed elastomer material to the bonding agent coated fastener head;

(e) curing the at least one sheet of catalyzed elastomer material to the bonding agent coated fastener head; and (f) cutting and trimming excess elastomer material from the edges of the fastener head.

17. The method of coating the head of a metal fastener according to claim 16, wherein the step of curing the bonding agent to the head of the metal fastener comprises steaming the bonding agent coated fastener head for providing sufficient humidity for hydrolysis of the bonding agent.

18. The method of coating the head of a metal fastener according to claim 16, wherein the step of curing the at least one elastomer sheet to the head of the metal fastener comprises applying heat and pressure to the at least one elastomer sheet and head of the metal fastener.

19. The method of coating the head of a metal fastener according to claim 16, wherein the step of catalyzing the elastomer material includes the step of adding a translucent tinting material to the elastomer sheet material.

20. The method of coating the head of a metal fastener according to claim 19, wherein the step of adding a translucent tinting material to the elastomer sheet material, includes the steps of:

(a) forming plural elastomer sheets each having a different translucent tint from one another; and (b) applying the plurality of differently tinted elastomer sheets to the bonding agent coated fastener head, to provide a multiply tinted translucent elastomer coating for the head of the metal fastener.

* * * * *